United States Patent [19]

MacDonald et al.

[11] Patent Number: 4,686,717

[45] Date of Patent: Aug. 18, 1987

[54] POOL COVER EXTENDING AND RETRACTING DEVICE

[76] Inventors: Scott H. MacDonald, 3736 Inglewood Blvd., #9; William E. MacDonald, 3455 Stoner Ave., both of Los Angeles, Calif. 90066

[21] Appl. No.: 846,127

[22] Filed: Mar. 31, 1986

Related U.S. Application Data

[63] Continuation of Ser. No. 615,934, May 31, 1984, abandoned.

[51] Int. Cl.[4] ..... E04H 3/18

[52] U.S. Cl. ..... 4/502

[58] Field of Search ..... 4/502, 500, 503; 192/67 R, 105 CF, 41 R, 46

[56] References Cited

U.S. PATENT DOCUMENTS

| | | | |
|---|---|---|---|
| 2,692,419 | 10/1954 | Curley . | |
| 2,754,900 | 7/1956 | Karobonik et al. | 4/502 |
| 3,050,743 | 8/1962 | Lamb | 4/502 |
| 3,499,174 | 3/1970 | Carey | 4/500 |
| 4,003,458 | 1/1977 | O'Steen | 192/105 CF |
| 4,126,214 | 11/1978 | Kiss | 192/46 |
| 4,192,411 | 3/1980 | Fogelberg | 192/67 R |
| 4,459,711 | 7/1984 | Sartain et al. | 4/502 |

FOREIGN PATENT DOCUMENTS 2072006 9/1981 United Kingdom .

*Primary Examiner*—Stephen Marcus
*Assistant Examiner*—Leo Peters
*Attorney, Agent, or Firm*—Drucker & Sommers

[57] ABSTRACT

A device for extending and retracting a pool cover, for covering and uncovering a pool. A mechanism for coupling and uncoupling cover driving and driven sections includes a floppy clutch mechanism including a floppy clutch arm, pivotally mounted and operable so as to rotate, pivot, and drop into and out of engagement responsive to rotational and gravitational forces, so as to provide positive coupling and uncoupling for cover operation. The cover driving section includes a cable reel which includes a pair of adjacent sections, to each of which one end of a cable is connected, with the opposite end of such cable connected to the cover leading edge, for enabling efficient extension of the pool cover. A pair of tracks are mounted directly in the sides of the pool, through which tracks the sides of the pool cover extend, and a pair of sliders are directly connected and secured to the cover leading edge, to provide support and guidance for the cover during extension and retraction thereof.

17 Claims, 21 Drawing Figures

Fig. 1
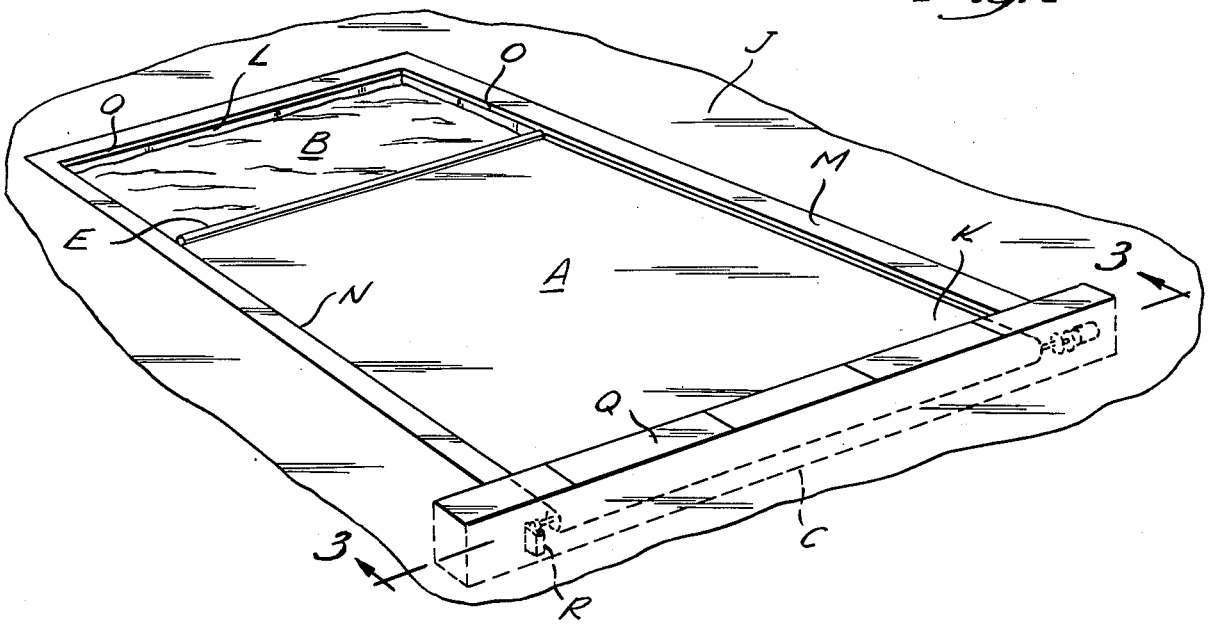
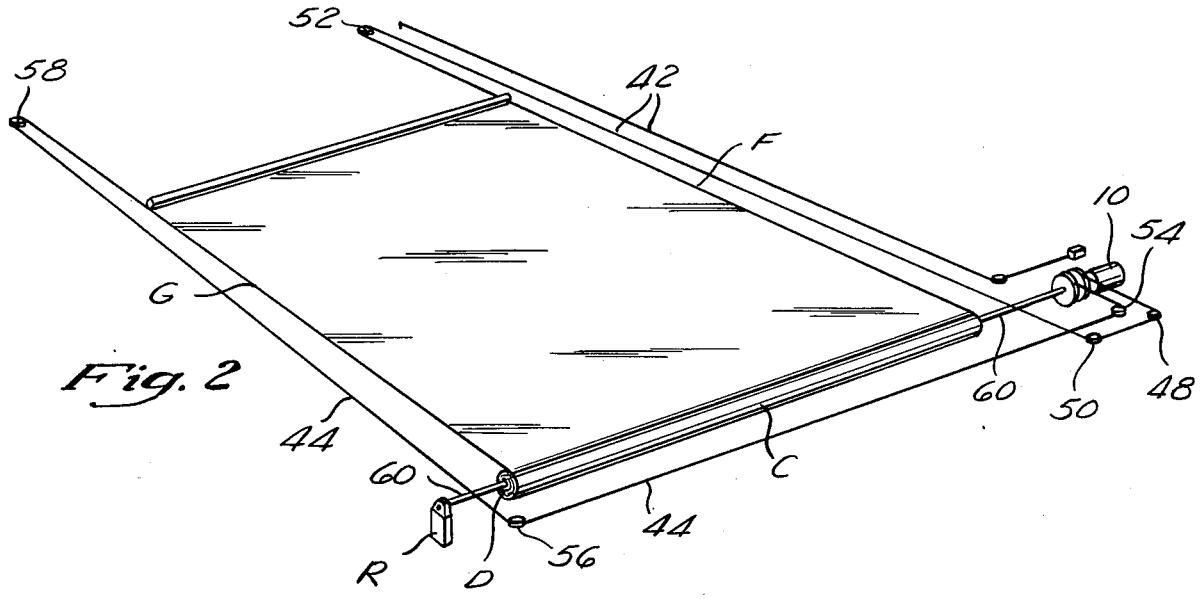
Fig. 2
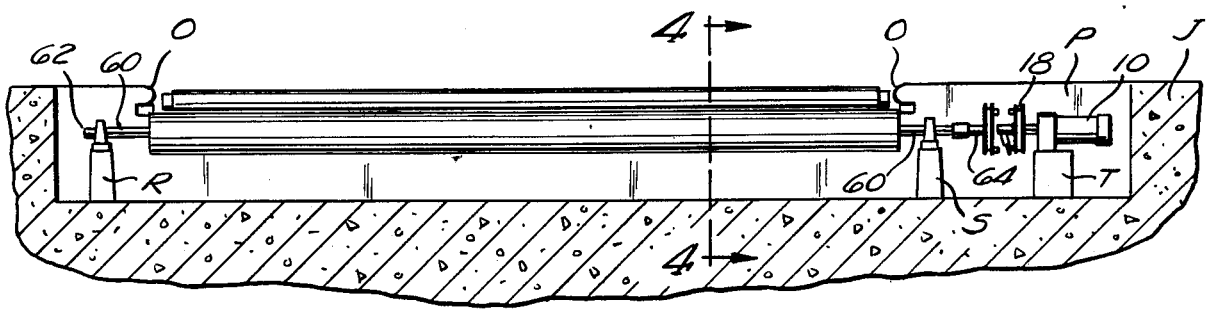
Fig. 3

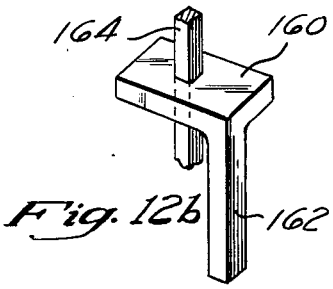
Fig. 12b
Fig. 11
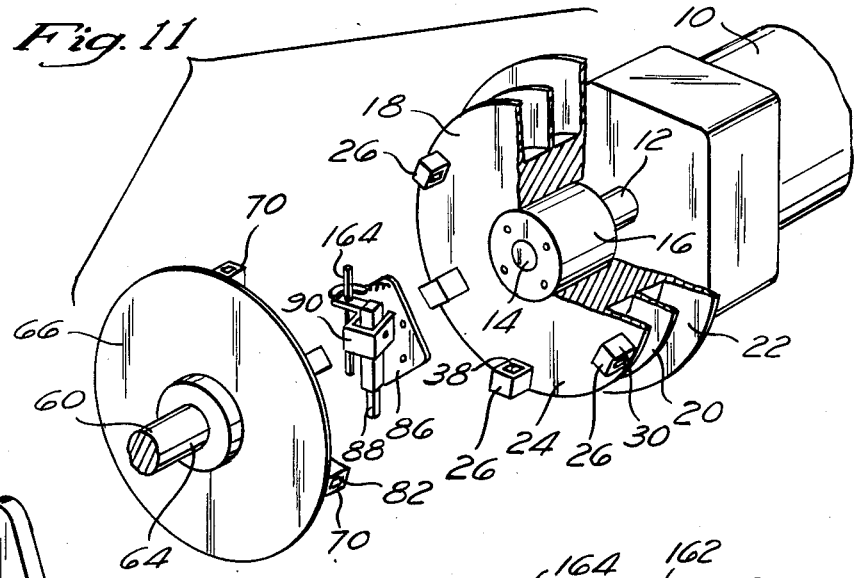
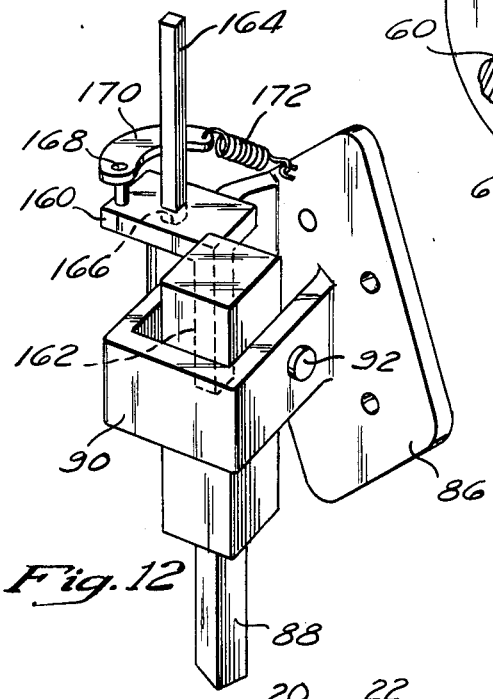
Fig. 12
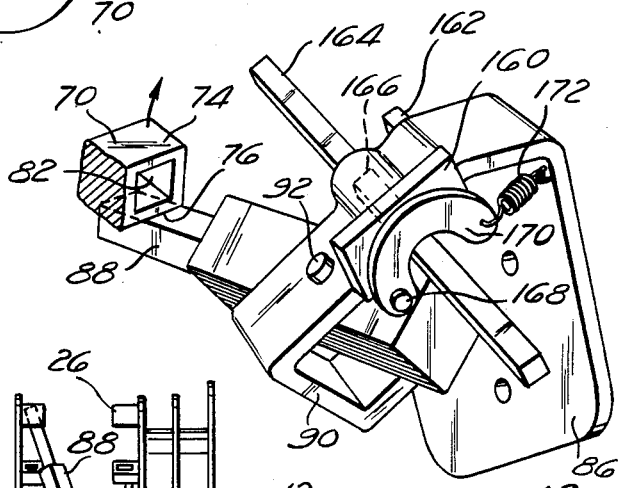
Fig. 13
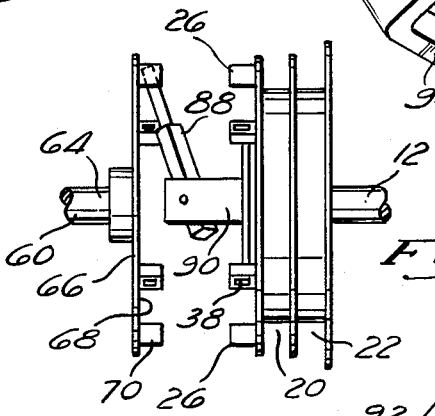
Fig. 13a
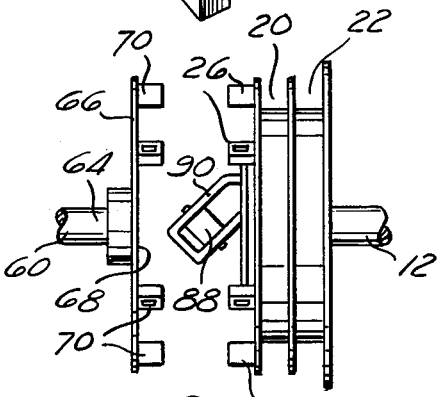
Fig. 12a
Fig. 14
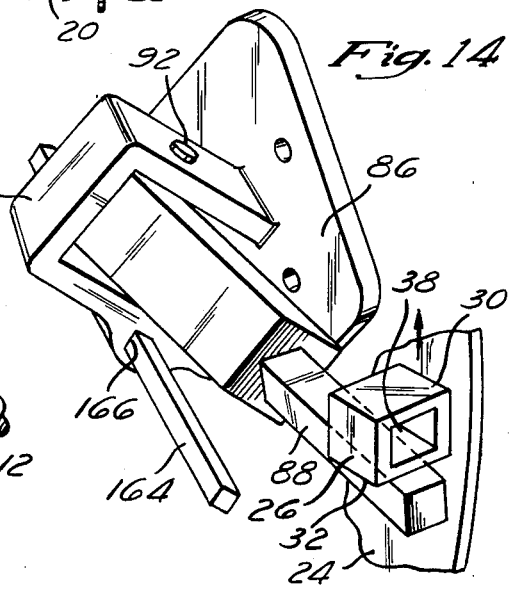
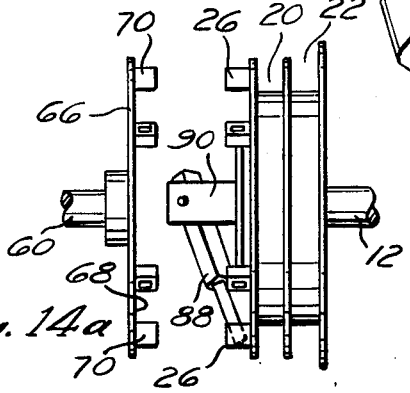
Fig. 14a Fig. 15
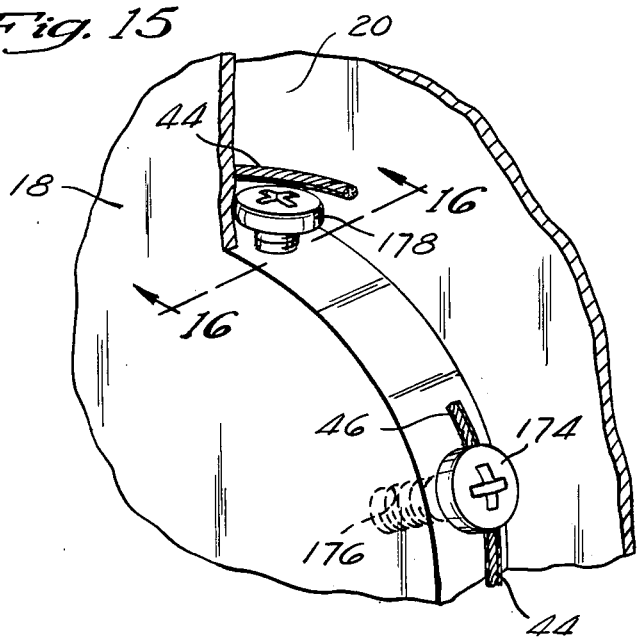
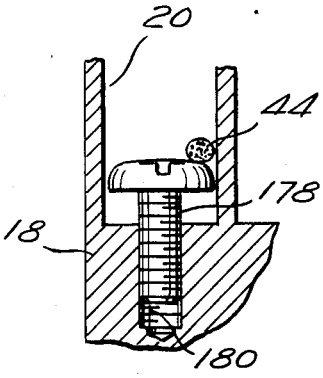
Fig. 16
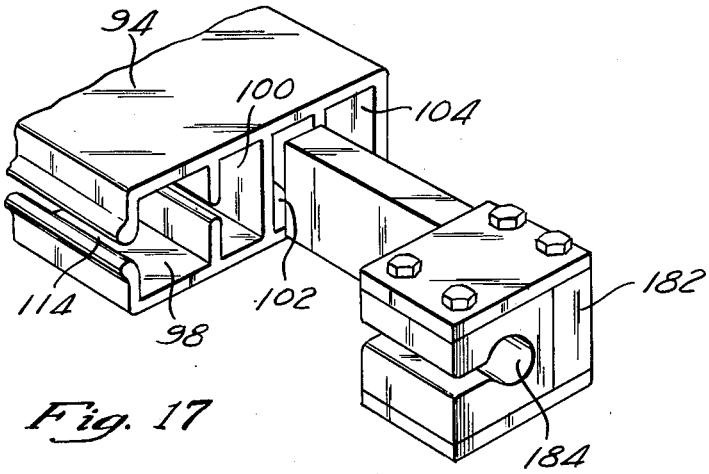
Fig. 17

POOL COVER EXTENDING AND RETRACTING DEVICE

RELATED APPLICATION

This application is a continuation of co-pending application Ser. No. 615,934, filed May 31, 1984, now abandoned.

BACKGROUND OF THE INVENTION

The invention related generally to pool covering devices, and relates specifically to a device for extending and retracting a pool cover.

It has been known in the art to extend or retract a pool cover, responsive to selective activation of a drive motor therefor, as for example in U.S. Pat. No. 3,050,743.

However, such pool covering devices have not been effective or efficient.

In U.S. Pat. No. 3,050,743, the mechanisms for extending the pool cover, and for coupling and uncoupling the drive motor relative to the drum on which the pool cover is wound, for extending and retracting the pool cover, includes driving and driven sections which extend operably over substantially the entire width of the pool, and which are complex and inefficient.

Further, such device includes a mechanism for supporting and guiding the pool cover which includes wheels connected to the leading edge of the cover so as to roll along the deck, exposed and operable above and outside the sides of the pool, which connections of the wheels and cover leading edge cause stresses and strains on the cover leading edge and on the pool cover.

SUMMARY OF THE INVENTION

The device of the invention is adapted to overcome the above problems, as well as others, associated with the prior art.

It includes a floppy clutch mechanism, for coupling and uncoupling the driving and driven sections of the cover extending and retracting device.

Such floppy clutch mechanism includes a floppy clutch arm, pivotally mounted at an angle so as to rotate, pivot, and drop responsive to rotational and gravitational forces, into and out of engagement with engagable elements projecting from the periphery of one or the other of a pair of directly-opposed plates in a relatively-small space between driving and driven sections, for compact, positive and efficient coupling and uncoupling thereof.

The device further includes a cover extending mechanism which includes a reel, rotatably positioned adjacent the end of the motor drive shaft, including a pair of adjacent reel sections, to each of which is connected one end of a cable, the opposite end of which cable is connected to the leading edge of the pool cover. Such reel and reel sections enable efficient and effective extension and retraction of the pool cover relative to the pool.

The device still further includes tracks and sliders, mounted in the side walls of the pool, in which tracks the sides of the cover extend, and which sliders are reciprocally operable. Such sliders are connected and secured directly to the sides of the leading edge of the pool cover, to provide effective and direct support therefor, and to efficiently guide the cover leading edge and the pool cover during extension and retraction thereof.

BRIEF DESCRIPTION OF THE DRAWINGS

FIG. 1 is a perspective view of a pool in which the cover extending and retracting device has been installed, with the pool cover partially extended so as to partially cover the pool, pursuant to the invention;

FIG. 2 is a similar schematic view of portions of the device;

FIG. 3 is an elevational end view of the device installed in the pool, taken on line 3—3 of FIG. 1;

FIG. 11 is a perspective exploded partly cross-sectional view of parts of the driving and driven sections of the device;

FIG. 12 is an elevational view of a section of the device in a neutralized position thereof;

Figure 4:
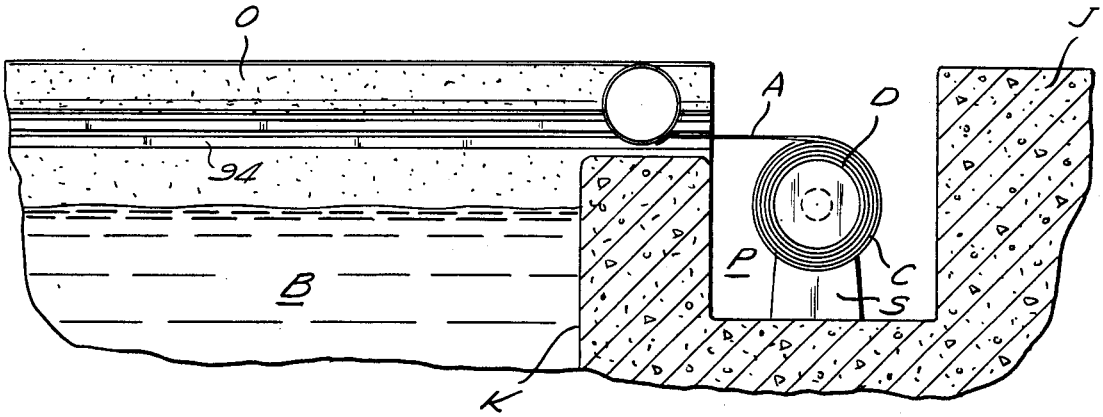
FIG. 4 is a similar view taken on line 4—4 of FIG. 3.

FIG. **12*a*** is an elevational view of parts of the driving and driven sections of the device in neutralized position;

FIG. **12*b*** is an elevational view of a portion of the neutralizing element of the device;

FIG. 13 is a perspective partly-fragmentary view of a portion of the device in a first coupled position thereof;

FIG. **13*a*** is an elevational view of portions of the device in the first coupled position thereof;

FIG. 14 is a perspective view of a portion of the device in a second coupled position thereof;

FIG. **14*a*** is an elevational view of portions of the device in the second engaged position thereof;

FIG. 15 is a fragmentary elevational view of a secion of a cable reel pursuant to the invention;

FIG. 16 is a partly cross-sectional elevational fragmentary view taken on line 16—16 of FIG. 15; and FIG. 17 is an exploded partly-fragmentary view of a cover feeder and track pursuant to the invention.

DESCRIPTION OF THE PREFERRED EMBODIMENTS

The device of the invention, as shown in FIGS. 1–17 and as described herein, enables a cover A to be extended over a pool B from retracted pool-uncovering position for covering pool B, and enables cover A to be retracted from extended pool-covering position for uncovering pool B, as directed by the user.

Cover A, as shown in FIGS. 1–4 and 9, includes an end C mounted on a drum D about which cover A is wound, a leading edge E at the opposite end of cover A, and opposed sides F and G. Cover A further includes reinforcements, as ropes H and I, secured at the edges of sides F and G and at leading edge E.

Pool B is formed in deck J, and includes ends K and L, sides M and N, and coping O extending about sides M and N and ends K and L thereof, as shown in FIGS. 1–4. A box P is formed in deck J proximate, and extending for a distance greater than the width of, end K of pool B. Box P may be enclosable by a removable covering, as Q, therefor. Supports R, S, and T are mounted in box P.

The device includes a mechanism which is rotatable and translatable so as to extend cover A from its retracted pool-uncovering position, such that cover A extends over pool B, for covering pool B, and A mechanism for rotatably driving the cover extending mechanism as shown in FIGS. 1–14 and 17.

The cover driving mechanism, as shown in FIGS. 1–3 and 8, includes a motor 10 adapted to be mounted on support S. A drive shaft 12 extends from motor 10 and includes a free end 14. A coupling 16 is secured to drive shaft 12, for rotation therewith. The cover extending mechanism, as shown in FIGS. 1–14 and 17, includes a reel 18 rotatably positioned on coupling 16 proximate the free 14 of drive shaft 12 for rotation thereon. Reel 18 includes two sections 20 and 22 adjacent each other, and a side disk portion surface 24 facing outwardly away from motor 10. A plurality of segments, as 26, 28, project outwardly from surface 24 of reel 18. The projecting segments, as 26, 28, are located proximate the perimeter of surface 24 of reel 18 at circumferentially spaced-apart locations thereon. Each projecting segment, as 26, 28, comprises, for example, a section of square tubing, including top and bottom bearing surfaces, as 30, 32, 34, and 36, and including openings, as 38, 40, extending therethrough, directed radially toward the center of surface 24. The openings, as 38, 40 are adapted to enable insertion of a tool therein for enabling manual rotation of reel 18 for manual unwinding of cover A.

The cover extending mechanism, as shown in FIGS. 1–2 and 4–9, further includes a mechanism for changing the direction of force generated thereby at end K of pool B into force exerted at the sides of leading edge E of cover A for unwinding cover A towards end L of pool B.

The direction changing mechanism includes a pair of cables 42, 44, each including a first end, as 46 shown in FIG. 15, and a second opposed end. End 46 of cable 44 is secured to section 20 of reel 18, and the corresponding end of cable 42 is secured to section 22 of reel 18. Each cable 42 and 44 is adapted to extend in box P proximate end K of pool B, along sides M and N of pool B, to locations proximate end L of pool B, and back in the direction of end K of pool B. A plurality of pulleys are each adapted to be mounted at locations relative to pool B to change the direction of, and direct, cables 42 gand 44. Pulleys 48, 50, and 52 direct cable 42 proximate to and along side M of pool B, and pulleys 54, 56, and 58 direct cable 44 along side N of pool B.

The device further includes a mechanism which is rotatable so as to retract cover A from its extended pool-uncovering position and which is adapted to be driven by the cover driving mechanism such that cover A retracts from its pool-covering position for uncovering pool B, as shown in FIGS. 1, 3, 4, and 8.

The cover retracting mechanism includes a shaft 60, rotatably mounted proximate its ends 62 and 64 at end K of pool A, in box P, on supports R and S. Drum D is mounted on shaft 60 for rotation therewith.

A disk 66 is mounted at end 64 of shaft 60 for rotation therewith. Disk 66 includes surface 68 thereof facing outwardly from end 64 of shaft 60, and a plurality of segments, as 70, 72, projecting outwardly away from drum D, as further shown in FIGS. 12, 12*a*, 13*a*, and 14*a*. The projecting segments, as 70, 72, are located peripherally on the perimeter of disk 66 at circumferentially spaced-apart locations thereon. Each projecting segment, as 70, 72, comprises for example a section of square tubing, including top and bottom bearing surfaces, as 74, 76, 78, and 80 and openings, as 82, 84, extending therethrough directed radially from the center of disk 66. The openings, as 82, 84, are adapted to enable insertion of a tool therein for enabling manual rotation of disk 66 for manual winding of cover A.

Figure 9:
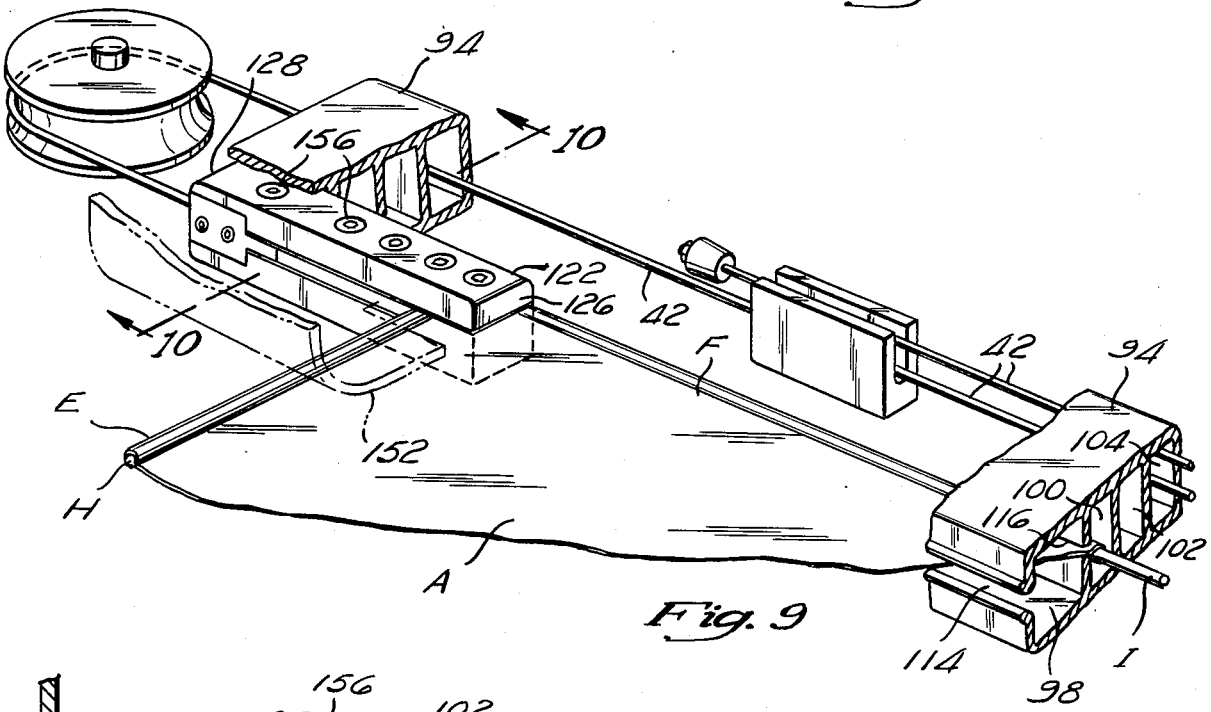
FIG. 9 is a partly-fragmentary perspective view of sections of the device.
Figure 10:
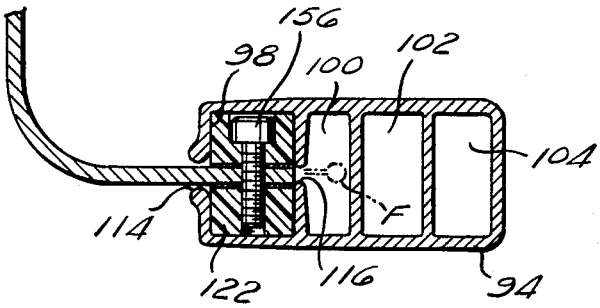
FIG. 10 is a cross-sectional elevational partly-fragmentary view taken on line 10—10 of FIG. 9.
Figures 5, 6, 7:
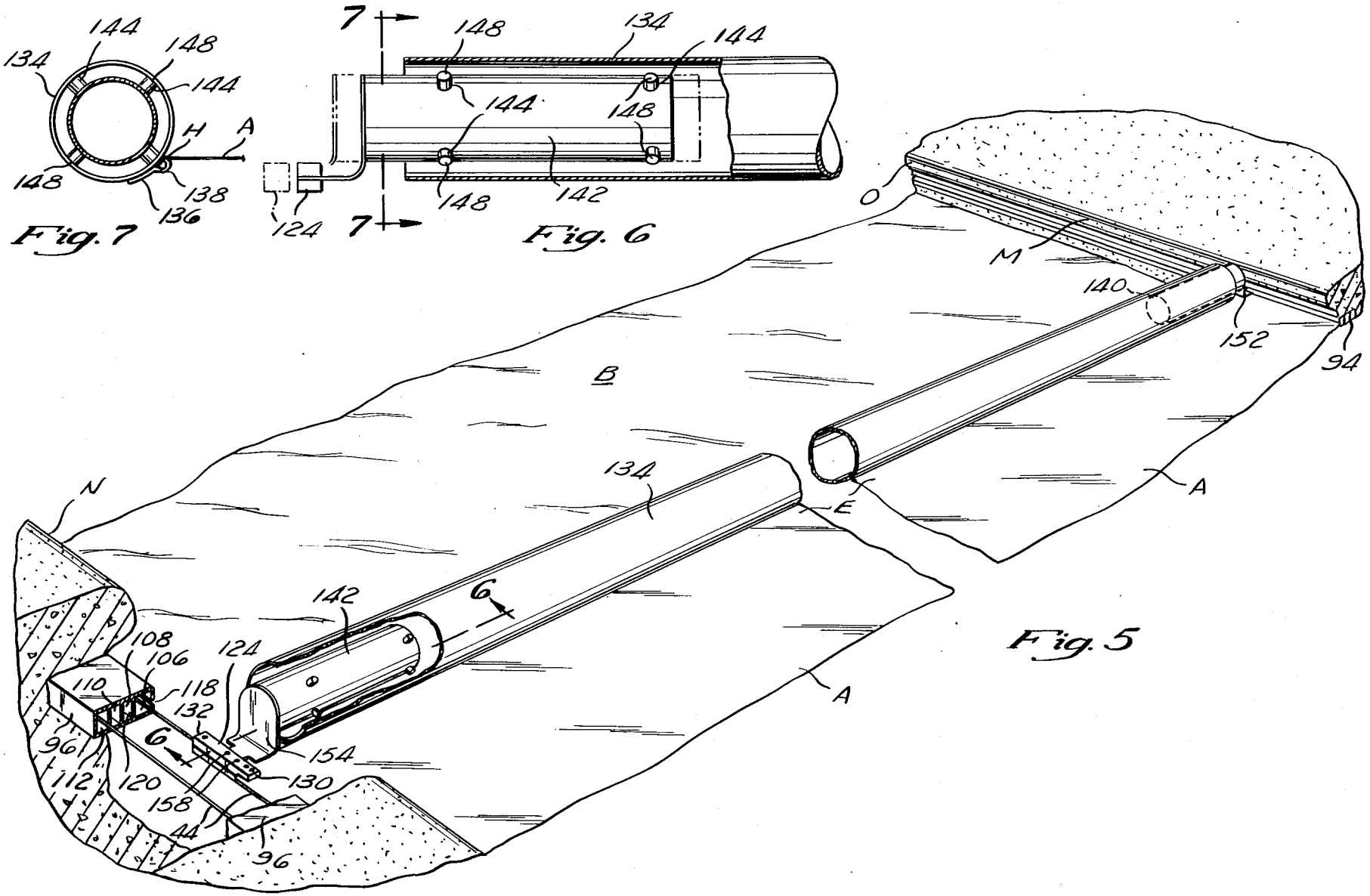
FIG. 5 is a perspective partly-fragmentary partly-broken view of the device, installed in the pool, with the cover partially covering the pool.
FIG. 6 is a fragmentary elevational view taken on line 6—6 of FIG. 5.
FIG. 7 is a cross-sectional elevational view taken on line 7—7 of FIG. 6.

The device still further includes a mechanism for supporting and guiding the sides of leading edge E of cover A in the sides M and N of pool B, to which the cover driving mechanism is connected, as shown in FIGS. 5, 9, and 10.

The supporting and guiding mechanism includes a pair of tracks 94 and 96, mounted in the sides M and N of pool B. Track 94 extends in and along side M of pool B, and track 96 extends in and along side N of pool B, for substantially the lengths thereof. Each track includes four channels extending substantially the lengths thereof. Track 94 includes channels 98, 100, 102, and 104 and track 96 includes channels 106, 108, 110, and 112. Cable 42 is reciprocally movable in channels 100 and 104 in track 94, and cable 44 is reciprocally movable in channels 108 and 112 of track 96.

Each track 94 and 96 further includes slots extends partially therethrough. Track 94 includes slot 114 extending substantially the length thereof through, and communicating with, the wall of channel 100 which faces into pool B. It further includes a slot 116 extending substantially the length thereof through the wall between, and communicating with, channels 98 and 100. Side F of cover A is adapted to extend through slots 114 and 116 in track 94, and rope I at the edge of side F of cover A is reciprocally movable in channel 100 of track 94.

Track 96 includes slot 118 extending substantially the length thereof through, and communicating with, the wall of channel 106 which faces into pool B. It further includes a slot 120 extending substantially the length thereof between, and communicating with, channels 106 and 108.

The supporting and guiding mechanism further includes a pair of sliders 122 and 124, each adapted to be slidably and reciprocally movable in a side of pool A in a channel of a track. Slider 122 is slidably movable in side M of pool A in channel 98 of track 94, and slider 124 is slidably movable in side N of pool A in channel 106 of track 96. Slider 122 includes opposed ends 126 and 128, and slider 124 includes opposed ends 130 and 132. The corner of cover A between leading edge E and side F is secured to end 126 of slider 122, and the corner of cover A between leading edge E and side G is secured to end 130 of slider 124, for supporting and pulling thereof. The second ends of cables 42 and 44 are secured in ends 128 and 132 of sliders 122 and 124.

The device still further includes a floppy clutch mechanism which is rotatable, for coupling and uncoupling the cover driving mechanism and the cover extending mechanism or the cover retracting mechanism. The floppy clutch coupling and uncoupling mechanism is adapted, upon coupling with the cover retracting mechanism, to enable cover A to be retracted from its pool-covering position, for uncovering pool A, and, upon coupling with the cover extending mechanism, to enable cover A to be extended from its pool-uncovering position for covering pool A.

The floppy clutch coupling and uncoupling mechanism, as shown in FIGS. 3, 8, and 12–13 includes a plate 86 secured to free end 14 of drive shaft 12 of motor 10. It further includes a floppy clutch arm 88, adapted to rotate, pivot, and drop, responsive to rotational and gravitational forces, to engage or disengage the bearing surfaces, as 32, 34, 36, and 38 and 74, 76, 78, and 80 on projecting segments, as 26, 28, and 70, 72, projecting from outer surfaces 24 and 68 of disk 66 and reel disc portion 18.

A generally U-shaped section 90 projects from plate 86 into the space between disk 66 and reel 18, and pin 92 extends therethrough and pivotally connects floppy clutch arm 88 thereto. Section 90 projects at an angle, preferably about 45°, from plate 86, such that arm 88 is pivotable about pin 92 in a plane non-perpendicular to plate 86. Arm 88 is rotatable with plate 86 to which it is connected.

A mechanism for enabling the force exerted in the sides F and G of pool B, at the sides of leading edge 14 of cover A, to be distributed substantially uniformly across the width of leading edge E of cover A, is provided.

An elongated tube 134 is secured to leading edge E of cover A for enabling the force exerted at the sides of leading edge E to be exerted substantially across the width of leading edge E. A mechanism for connecting tube 134 to the guiding mechanism is further provided.

Figure 8:
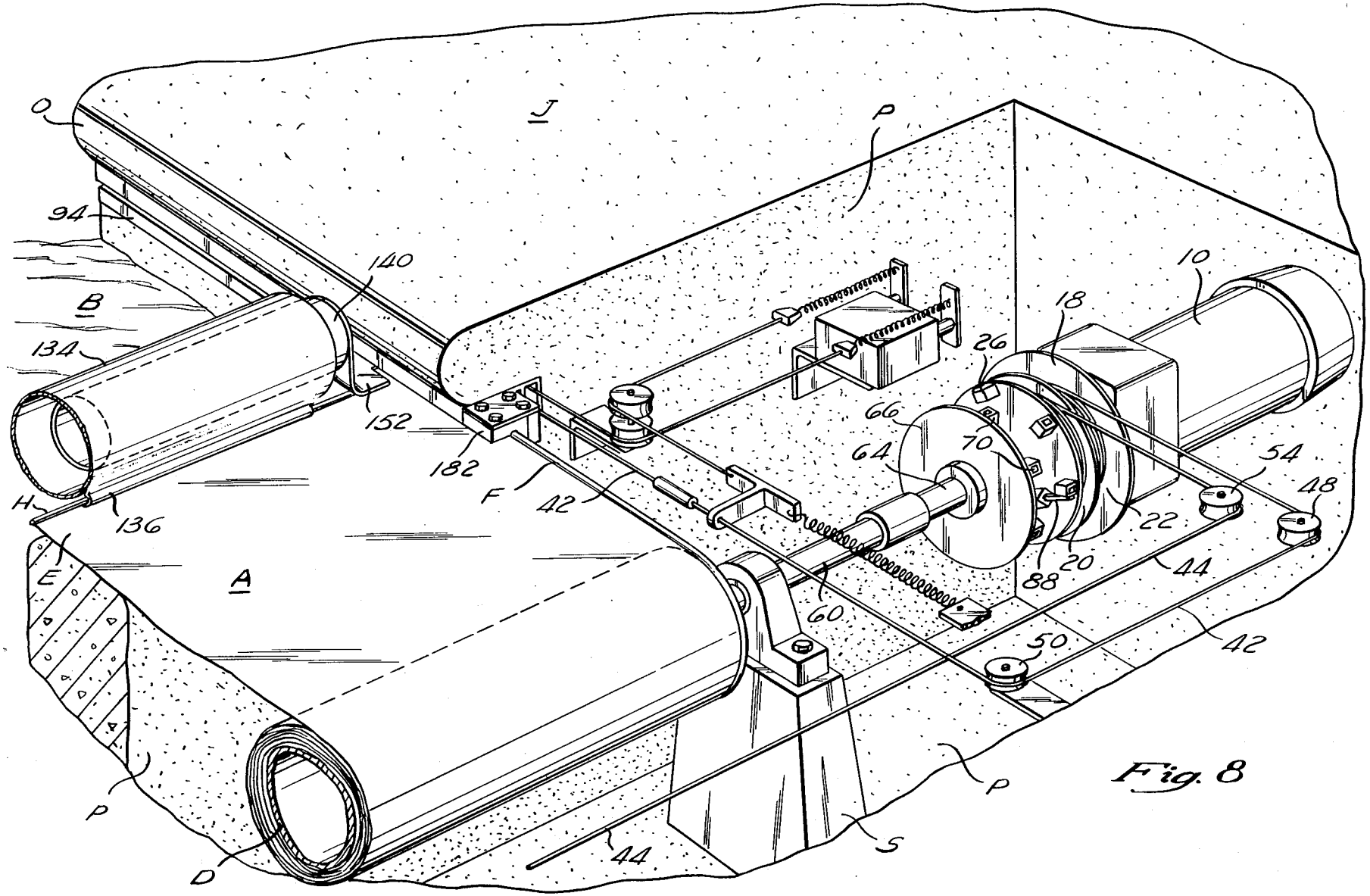
FIG. 8 is a perspective partly-fragmentary view of sections of the device.

Elongated tube 134, as shown in FIGS. 7 and 8, extends across a substantial portion of the width of leading edge E of cover A. A plate 136 is secured to tube 134 for substantially the length thereof. Plate 136 includes a clamping portion 138, which clamps rope H therein for securing thereof to tube 134, such that leading edge E of cover A moves with tube 134.

The connecting mechanism, as shown in FIGS. 5, 6, 7, and 8, is adapted to expand or contract responsive to expansions or contractions in the width of pool A along the length thereof. It includes a pair of tube segments 140 and 142, telescopically slidable at the ends of tube 134. A plurality of button-like members, as 144, 146, project radially-outwardly from tube segments 140 and 142. The outer surfaces, as 148, 150, of the projections, as 144, 146, are adapted to contact the inner surface of tube 134, enabling telescopically slidable movement of tube segments 140 and 142 therealong.

End plates 152 and 154 are each connected at one end to the outer end of tube segments 140 and 142, and are pivotally connected, at the other end thereof, to sliders 122 and 124 by screws 156 and 158.

The device further includes a mechanism for neutralizing arm 88 of the coupling and uncoupling mechanism, as shown in FIGS. 12 and 13. The neutralizing mechanism includes a plate 160, pivotally connected to one side of U-shaped section 90 of plate 86, including an arm portion 162 projecting from one corner of plate 160. Arm portion 162 is adapted to be pivotable into and out of a position, as shown in FIG. 12, blocking pivoting of arm 88. A shaft 164 extends through a channel 166 in U-shaped section 90 of plate 86, and through plate 160, thereby connecting plate 160 to U-shaped section 90. Shaft 164 is adapted to be engaged at one end thereof by a key (not shown) for enabling manual turning thereby of plate 160. A pivot pin 168, curved arm 170, and spring 172 connect plate 160 to plate 86 to retain plate 160 in either of two positions of floppy clutch arm 88, neutralized or freely movable.

The device, as shown in FIGS. 15–17, further includes an element for enabling adjustment of the length of the cable, an element for enabling adjustment of the diameter of winding of the cable about the reel sections, and an element for feeding the sides of the cover through the tracks.

The element for enabling adjustment of the length of cable from the reel to the slider comprises a screw threadably connected in an opening in a reel section for securing the end of the cable to the wire drum. Screw 174, as shown in FIG. 15, is threadable into opening 176 in reel section 20, with cable end 46 secured therebetween at the desired location for adjusting the length of cable 44, as desired. A similar adjustable end connection (not shown) is provided for cable 42 on reel section 22.

The element for adjusting the winding of the cables about the reel sections comprises a further screw threadably connected in a further opening in a reel section for winding the cable thereabout. Screw 178, as shown in FIGS. 15 and 16, is threadable into opening 180 in reel section 20, with cable 44 wound thereabout at the desired increased radius of reel section 20. A similar adjustable winding element (not shown) is provided for cable 42 on reel section 22.

The element for feeding the sides of the cover through the tracks comprises a feeder 182, as shown in FIG. 17, adapted to be mounted at the end of track 94 proximate motor 10, in channel 102 of track 94. Feeder 182 includes a slot 184, adapted to provide aligned feeding of side F of cover A into and through channel 100 of track 94. A similar feeder (not shown) is provided for side G of cover A in track 96.

Initially, cover A may be extended over pool B from its retracted pool-uncovering position, for covering pool B, by motor 10, as shown in FIG. 8, selectively operable by the user, by activating a suitable switch connected thereto (not shown) so as to generate rotation, for example, in the counterclockwise direction of drive shaft 12, for driving the device.

Such rotation of drive shaft 12 generates like rotation of plate 86 secured to the end thereof, and like rotation of floppy clutch arm 88 connected to plate 86 by pin 92 and U-shaped section 90. Further, floppy clutch arm 88 pivots on pin 92 in a plane at an angle, for example 45°, of projection of U-shaped section 90, towards the outer surface 24 of reel 18. Such counterclockwise rotation and angled pivoting of floppy clutch arm 88 causes it to rotate, pivot, and drop, responsive to rotational and gravitational forces, into engagement with the bottom bearing surface, as 32, projecting from the outer surface 24 of reel 18, as shown in FIGS. 14 and 14*a*, for connecting motor 10 to reel 18 for driving thereof.

Engagement of floppy clutch arm 88 with bottom bearing surface 32 of reel 18 causes reel 18 to rotate with drive shaft 12, in the counterclockwise direction. Such counterclockwise rotation of reel 18 causes cables 42 and 44 to be wound on and about reel sections 20 and 22, as shown in FIG. 2. The rotational force generated in winding cables 42 and 44 about drum sections 20 and 22 and exerted on cables 42 and 44 at one end, as 46, thereof, is changed, through pulleys 48 and 54, into translational force exerted through cables 42 and 44. Such translational force is transmitted through cables 42 and 44, directed by pulleys 50 and 56, channels 104 and 112 in tracks 94 and 96, pulleys 52 and 58, channels 98 and 106 tracks 94 and 96, and sliders 122 and 124 to which the other ends of cables 42 and 44 are secured, for application to the sides of leading edge E of cover A, for pulling cover A towards end L of pool B.

The pulling force exerted at the sides of leading edge E of cover A by cables 42 and 44 through sliders 122 and 124 secured thereto enables supporting and pulling of leading edge E thereby, and is distributed substantially uniformly across leading edge E of cover A by elongated tube 134, for enabling force exerted at the sides of leading edge E of cover A to be exerted substantially uniformly across the width of leading edge E of cover A.

To retract cover A from its extended pool-covering position, for uncovering pool B, motor 10 as shown in FIG. 8, is selectively reversible by the user by activating a suitable switch connected thereto (not shown) so as to generate rotation, for example, in the clockwise direction of drive shaft 12, for driving the apparatus in the opposite direction.

Such rotation of drive shaft 12 generates like rotation of plate 86 secured to the end thereof, and like rotation of floppy clutch arm 88 connected to plate 86 by pin 92 and U-shaped section 90. Further, floppy clutch arm 88 pivots on pin 92 in a plane at an angle, for example 45°, of projection of U-shaped section 90, away from the outer surface 24 of reel 18, into the space between reel 18 and disk 66 on shaft 60, and toward the outer surface 68 of disk 66. Such clockwise rotation and angled pivoting of arm 88 causes it to rotate, pivot, and drop, responsive to rotational and gravitational forces, into engagement with the bottom bearing surface, as 76, projecting from the outer surface 68 of disk 66, as shown in FIGS. 13 and 13*a*, for connecting motor 10 of disk 66 for driving thereof.

Engagement of floppy clutch arm 88 with bottom bearing surface 76 of disk 66 causes disk 66 to rotate with drive shaft 12, in the clockwise direction. Such clockwise rotation of disk 66 causes shaft 60, to which disk 66 is secured, to rotate therewith. Such rotation of shaft 60 in turn causes like rotation of drum D, secured to shaft 60, winding cover A on drum D, for pulling cover A towards end K of pool B. Sliders 122 and 124, secured to the corners of cover A at end E thereof, are movable therewith in tracks 94 and 96, supporting and securely pulling cables 42 and 44. Cables 42 and 44 are directed by channels 98 and 106 in tracks 94 and 96, pulleys 44 and 58, channels 104 and 112 in tracks 94 and 96, pulleys 50 and 56, and pulleys 48 and 54 from reel 18. Such movement of cables 42 and 44 causes them to be unwound from reel sections 20 and 22 in reel 18, disengaged from arm 88 and freely rotatable on coupling 16 on drive shaft 12, as shown in FIG. 2, enabling cover A to be pulled towards end K of pool B.

Movement of cover A in unwinding or winding, towards ends L or K of pool B, on sliders 122 ans 124, to which the corners of cover A at leading edge E thereof are secured, and along tracks 94 and 96, is guided by cover feeders, as 182 and slots, and 184 in feeder 182, slots 114 and 116 in track 94 and slots 118 and 120 in track 96. Movement of leading edge E of cover A towards ends L or K of pool B is enabled, through points of varying parallelism of sides F and G of pool B, by telescopic movement of tube segments 140 and 142, on projecting members, as 144, 146, relative to elongated tube 134 for accommodating variations in pool constructions. Such cover movement is further enabled by pivotal connection, through screws 156 and 158, of end plates 152 and 154 to sliders 122 and 124.

To prevent floppy clutch arm 88 from pivoting, it is immobilized in the position of the parts shown in FIG. 12. In such position, arm extension 162 bears against the rear surface of arm 88, blocking movement of same. Normally compressed spring 172 is extended, thereby biasing arm extension 162 counterclockwise into the position shown in FIG. 12.

To enable pivoting of floppy clutch arm 88, as shown in FIG. 13, a suitable key is engaged at the end of shaft 164, rotatably journalled in channel 166 in the extension of U-shaped frame 88, and such key and shaft 164 are rotated counterclockwise, rotating plate 160, arm extension 162, and connector arm 170 therewith. Such movement rotates arm extension 162 into the position in FIG. 13 away from arm 88, retained therein by compressed spring 172, permitting pivoting of arm 88.

To return to the position in FIG. 12, the key engages shaft 162, and such key and shaft 164 are rotated clockwise such that the parts are moved into the positions in FIG. 12, with arm 88 immobilized.

For manual operation of the apparatus, as for example, in the event of an operational failure or in an emergency, arm 88 may be neutralized, as shon in FIG. 12, 12*a*, and 12*b*, so as not to be engagable with reel 18 or disk 66. Such neutralizing may be effected by engaging shaft 164 with a suitable key (not shown) and rotating shaft 164, and plate 160 through which shaft 164 etends therewith. Such rotation of plate 160 causes arm portion 162 thereof to be pivoted into a position, as shown in FIG. 12, blocking movement of arm 88.

With arm 88 neutralized, manual rotation of disk 66, for winding cover A to uncover pool B, may be effected by insertion of a suitable tool (not shown) into an opening, as 82, 84, in projecting segments, as 70, 72 in disk 66, shown in FIG. 8, and manually rotating disk 66 by means thereof. Further, manual rotation of reel 18, for unwinding cover A to cover pool B, with arm 88 neutralized, may be effected by insertion of a suitable tool (not shown) into an opening, as 38, 40, in projecting segments, as 26, 28, in reel 18, shown in FIG. 8, and manually rotating reel 18 by means thereof.

Adjustment of the length of cables 42 and 44 may be effected, as shown in FIG. 15, by securing the cable end, as 46, between a screw, as 172, and reel sections 130 and 132, at the desired location on such cables 38 and 40.

Adjustment of the wrapping of cables 42 or 44 about reel sections 20 or 22 may be effected, as shown in FIGS. 15 and 16, by threading a screw, as 178, in reel sections 20 and 22, to the desired height, for the desired winding of cables 42 or 44 thereabout.

The floppy clutch mechanism, including pivotally-mounted floppy clutch arm 88, enables extension of cover A from its retracted pool-uncovering position, for covering pool B, or retraction of cover A from its extended pool-covering position for uncovering pool B, responsive to rotational and gravitational forces, in an effective, efficient and convenient manner.

The adjacent sections 20 and 22 of reel 18, to which first ends of cables 42 and 44 are secured, enable direct driving of cables 42 and 44 by motor drive shaft 12 from the location of reel 18 adjacent motor 10, for effective and efficient driving of cables 42 and 44 and extension of cover A thereby.

Sliders 122 and 124, reciprocally slidably movable in sides M and N of pool B in tracks 94 and 96, and to which leading edge E of cover A is secured, enable effective and secure supporting of leading edge E of cover A for extending or retracting cover A relative to pool B. Feeders, as 182, and slots 114, 116, 118, and 120 in tracks 94 and 96, effectively guide cover A.

Pulleys 48, 50, 54, 56, and 58 about which cables 42 and 44 pass, enable effective changing of the direction of application of force transmitted to sliders 122 and 124 from reel sections 20 and 22.

Elongated tube 134 effectively provides substantially uniform distribution of forces from sliders 122 and 124 across leading edge E of cover A. Slidable tube segments 142 and 144 are telescopically and pivotally connected to efficiently accommodate variations in parallelism of pool sides F and G.

The manually operable elements, including projecting segments 26, 28 in reel 18 having openings, as 38, 40 therein and projecting segments, as 70, 72 in disk 66 having openings, as 82, 84 therein, enable a suitable tool to be inserted thereinto for enabling manual extenion or retraction of cover A if required.

The neutralizing machanism, including arm portion 160 of plate 158, enables neutralizing of the floppy clutch arm 88, preventing such arm 88 from pivoting and dropping into engagement with reel 18 or disk 66.

Screws, as 174, 176, threadably connected in drum sections 20 and 22 of reel 18, effectively provide for adjustments of the length and wrapping of cables 42 and 44.

A preferred embodiment of the device of the invention has been set forth above, for the purpose of explaining the invention. However, it is to be understood that variations may be made in such embodiment, which variations are nevertheless within the scope and spirit of the invention as set forth in the claims herein.

We claim:

1. A device for enabling a cover to be extended over a pool from retracted pool-uncovering position, for covering the pool, and for enabling the cover to be retracted from extended pool-covering position for uncovering the pool, as desired by the user, comprising:

(a) means which are rotatable and translatable so as to extend the cover from its retracted pool-uncovering position, for covering the pool;

(b) means which are rotatable so as to retract the cover from its extended pool-covering position, for uncovering the pool;

(c) means for rotatably driving the cover extending means and the cover retracting means; and (d) means which are rotatable, for coupling and uncoupling the cover driving means and the cover extending means or the cover retracting means, adapted upon coupling with the cover retracting means to enable the cover to be retracted from its pool-covering position for uncovering the pool, and upon coupling with the cover extending means to enable the cover to be extended from its pool-uncovering position for covering the pool, comprising a rotatable floppy clutch mechanism, adapted, upon rotation thereof, dependent upon the direction of rotation of the cover driving means, and responsive to the force of gravity thereon, to engage the cover driving means for coupling with the cover extending means, or to engage the cover retracting means for coupling therewith.

2. A device as in claim 1, further comprising means for enabling manual operation of the cover extending means.

3. A device as in claim 1, further comprising means for enabling manual operation of the cover retracting means.

4. A device as in claim 1, further comprising means for enabling neutralizing of the cover coupling and uncoupling means.

5. A device as in claim 1, in which the cover driving means comprise a motor including a drive shaft extending therefrom, and in which the cover coupling and uncoupling means comprise a floppy clutch arm, mounted on the cover driving means so as to enable pivoted movement thereof, and means in the cover extending means and in the cover retracting means adapted to be engaged by the floppy clutch arm.

6. A device as in claim 1, in which the cover includes first and second opposed ends, the cover retracting means comprise a driven shaft, a drum mounted on the driven shaft, to which the first end of the cover is secured for winding and unwinding of the cover thereon and a disk, mounted on one end of the driven shaft proximate the driving means, which disk includes an outer surface thereof facing away from the cover drum, and a bearing surface on the outer surface thereof, in which the cover driving means comprise a motor including a drive shaft extending therefrom in which the cover extending means include a reel, positioned rotatably proximate the free end of the drive shaft, which reel includes first and second sides, the first side thereof proximate the free end of the drive shaft comprising a disk portion which includes an outer surface thereof facing away from the motor, and a bearing surface on the outer surface thereof, which motor is adapted to be mounted proximate the driven shaft such that the drive shaft is aligned with the driven shaft and the outer surfaces of the driven shaft disk and reel disk portion are opposed to each other and spaced apart, and in which the cover coupling and uncoupling means comprise a plate, secured to the free end of the drive shaft, a floppy clutch arm, adapted to engage or disengage the bearing surfaces on the driven shaft disk or the reel disk portion, and means for pivotally mounting the floppy clutch arm on the plate so as to enable the arm to be rotatable with the plate and pivotable, in the space between the outer surfaces of the driven shaft disk and the reel disk portion, into and out of engagement with the bearing surfaces on the outer surfaces of the driven shaft disk and the reel disk portion dependent upon the direction of rotation of the cover driving means and responsive to the force of gravity thereon.

7. A device as in claim 4, in which the cover coupling and uncoupling means comprise a floppy clutch arm, and in which the neutralizing enabling means comprise a shaft adapted to block pivoting of the arm, and means for enabling the shaft to be moved into and out of a position blocking pivoting of the arm.

8. A device as in claim 6, in which the floppy clutch arm mounting means are adapted to enable the floppy clutch arm to pivot in a plane non-perpendicular to the plane in which the motor drive shaft disk rotates.

9. A device as in claim 6, further comprising means for enabling manual operation of the cover extending means which comprise the bearing surface on the outer surface of the reel disk portion, adapted to be engaged by means for enabling manual rotation of the reel disk portion.

10. A device as in claim 6, further comprising means for enabling manual operation of the cover retracting means which comprise the bearing surface on the outer surface of the driven shaft disk adapted to be engaged by means for enabling manual rotation of the driven shaft disk.

11. A device as in claim 6, in which the outer surface of the driven shaft disk includes a further bearing surface.

12. A device as in claim 6, in which the outer surface of the reel disk portion includes a further bearing surface.

13. A device as in claim 6, in which the bearing surface in the outer surface of the driven shaft disk is adapted to project outwardly therefrom.

14. A device as in claim 6, in which the bearing surface in the outer surface of the reel disk portion is adapted to project outwardly therefrom.

15. A device as in claim 13, in which the bearing surface includes an opening therein adapted to be engaged by means for enabling manual rotation of the driven shaft disk.

16. A device as in claim 14, in which the bearing surface includes an opening therein adapted to be engaged by means for enabling manual rotation of the reel disk portion.

17. A device as in claim 1, further comprising means for supporting and guiding the sides of the leading edge of the cover in the sides of the pool, to which the cover extending means are connected.

* * * * *